252-97 AU 165 EX
6/29/76 XR 3,966,629

United States Patent [19]
Dumbrell

[11] 3,966,629
[45] June 29, 1976

[54] TEXTILE SOFTENING DETERGENT COMPOSITIONS

[75] Inventor: Richard John Dumbrell, Blyth, England

[73] Assignee: The Procter & Gamble Company, Cincinnati, Ohio

[22] Filed: Aug. 23, 1974

[21] Appl. No.: 500,096

[30] Foreign Application Priority Data

Aug. 24, 1973 United Kingdom ..... 40205/73
Aug. 31, 1973 United Kingdom ..... 41085/73

[52] U.S. Cl. ..... 252/140; 8/137; 23/313 R; 252/135; 252/160; 252/97; 252/8.6; 252/8.8; 252/528; 252/538; 252/539

[51] Int. Cl.[2] ..... C11D 3/12; C11D 7/10

[58] Field of Search ..... 252/140, 135, 160, 539, 252/97, 8.6, 8.8, 528, 536; 8/137; 23/313

[56] References Cited

UNITED STATES PATENTS 3,852,211 12/1974 Ohren ..... 252/535 X
3,862,058 1/1975 Nirschl et al. ..... 252/528 X

*Primary Examiner*—Mayer Weinblatt
*Attorney, Agent, or Firm*—Forrest L. Collins; Richard C. Witte; Thomas H. O'Flaherty

[57] ABSTRACT

Granular built laundry detergent compositions comprising smectite-type clay materials and prepared by specified processes.

11 Claims, No Drawings

TEXTILE SOFTENING DETERGENT COMPOSITIONS

PRIOR ART

The invention disclosed in the copending commonly assigned U.S. Patent Application Ser. No. 271,943 relates to a granular built laundry detergent composition which provides simultaneous laundering and softening of textiles during conventional fabric laundering operations, which composition comprises (A) from 2% to 30% by weight of a non-soap synthetic detergent selected from: anionic synthetic detergents, ampholytic synthetic detergents, zwitterionic synthetic detergents and mixtures thereof; (B) from 10% to 60% by weight of an organic or inorganic detergent builder salt; and (C) from 1% to 50% by weight of a smectite-type clay softening agent having an ion exchange capacity of at least 50 meq/100 g, the composition providing a solution pH of from 7 to 12 when dissolved in water at a concentration of 0.12% by weight.

It is taught that these compositions may be prepared by simply mixing the appropriate ingredients in dry form.

DESCRIPTION OF THE INVENTION

Dry mixing of the fine clay and the spray-dried detergent granules tends to cause dust and to produce a dusty product. These disadvantages can be minimized by employing the present invention, whereby the clay is bonded to carrier granules or incorporated in them. It has now been found that this can be achieved by agglomerating the clay and carrier granules, but, because of the peculiar colloidal properties of the smectite-type clays, precautions must be taken so that the process is practicable and so that the full softening potential of the clay is preserved.

Alternatively, these smectite-type clays can be added directly, in powder form, to the slurry (henceforward referred to as the crutcher mix) which is to be spray-dried to make the spray dried granular portion of the laundry composition. The addition of clays of this type, which swell in water, would be expected to cause thickening of the crutcher mix, causing difficulty in pumping and spraying during processing, or making it necessary to dilute the mix thereby increasing the drying load. Surprisingly, it is found that these difficulties do not occur or occur only slightly either with the moderately swelling calcium-based clays or even with the strongly swelling sodium-based clays, and furthermore the products have substantially as good textile-softening properties as those prepared by the methods disclosed in the copending application wherein the clay is not intimately mixed with the surface active components.

According to the present invention, there is provided a built laundry detergent composition as described in U.S. Patent Application Ser. No. 271,943 when prepared (a) by a process wherein a moving bed of a particulate carrier (as defined hereinafter), optionally also containing some or all of the clay for the composition, is sprayed with a liquid agglomerating agent or a suspension therein of the rest, if any, of the clay for the composition, to form free-flowing agglomerates comprising said clay and said carrier, and thereafter said agglomerates are dry mixed with other particulate components, if any, of the composition; or (b) by a process wherein some or all of the clay for the composition is added in substantially dry pulverulent form to the crutcher mix, which is thereafter spray-dried to form the spray-dried component of the composition, the spray-dried component being thereafter dry mixed with other particulate components, if any, of the composition; or (c) by a combination of processes (a) and (b).

In compositions made by process (a), the weight ratio of agglomerating agent to combined weight of clay and carrier is preferably from 1 to 40 percent.

All the clay may be dispersed in the agglomerating fluid so as to provide a sprayable dispersion, and the dispersion sprayed onto a moving bed of the carrier to form free-flowing agglomerates.

The carriers are defined herein as granular, relatively non-dusty materials to which the clay can be bonded by physical bonding, and they are or they contain incompletely hydrated hydratable inorganic salts. The clay-bonding process may also bond fine particles of carrier together so as even to reduce the original dustiness of the carrier. Carriers which may be used according to the invention are sodium or potassium, but usually sodium, tripolyphosphates, acid and neutral pyrophosphates, carbonates, sulfates, borates, silicates, and spray-dried built synthetic detergent granules. Expecially useful carriers are incompletely hydrated sodium tripolyphosphate, tetrasodium and disodium pyrophosphates, and spray-dried built synthetic detergent granules. Of course, the spray-dried granules must contain a hydratable inorganic salt, and have been dried to such an extent that the salt is incompletely hydrated.

The clay may first be sprayed with fatty acid to control dust when it is to be dry mixed with the carrier. Suitable agglomerating agents are liquids at temperatures below about 60°C. When all the clay is to be dry mixed with the carrier before being sprayed, suitable agents include fatty acids having 10 to 24 carbon atoms; dilute, i.e. not over 75% saturated, aqueous solutions of electrolytes; water; and solutions of organic adhesives.

The most convenient fatty acids are those with 12–14 carbon atoms, for example coconut fatty acids, but if, for instance, it is desired to take advantage of the suds-depressant properties of the long-chained fatty acids, they can be used with suitable melting and spraying equipment.

Preferred agglomerating agents are water and dilute electrolyte solutions.

Usually in this embodiment of the invention, the weight ratio of clay to carrier is up to about 1:1.

When some or all of the clay is to be dispersed in the agglomerating agent and the dispersion sprayed on a carrier, the same agglomerating agents can be used, but generally electrolyte solutions are preferred. Water is only applicable when dilute clay dispersions are suitable, or when certain clays, which do not form too viscous or gelatinous dispersions, are employed. Clays that give thick or gelatinous dispersions in water, however, can be made into more concentrated, but still sprayable, dispersions in electrolyte solutions and in fatty acids, as described above. Suitable electrolytes include water-soluble phosphates, tripolyphosphates and acid and neutral pyrophosphates, carbonates, sulfates, chlorides, borates and silicates and mixtures thereof. The solutions should be less than 75% saturated, and are usually quite dilute. Thus a very effective solution contains from 3 to 10% of disodium pyrophosphate or of a 2:1 by weight mixture of disodium pyrophosphate and sodium chloride, especially about 5% and 2½% of these salts respectively. Sodium silicate solutions, of ratio $SiO_2$:$Na_2O$ from 1:1 to 3.6:1, and of up to about 50% solids concentration may be employed, for instance those commonly marketed.

As a guide, the clay dispersions in these liquids can often contain up to about 60%, preferably 20% to 50% by weight of the dispersion of clay, especially about 33%. The carrier used may, for example, be sodium tripolyphosphate and it may be sprayed with about 50% weight of a dispersion containing 33% by weight of clay in an aqueous solution containing 5% of disodium pyrophosphate and 2½% sodium chloride. However, in practice the amount of dispersion to be sprayed on, and the amount of clay in it, are best found by calculation and trial in each case. Factors to be considered include the amount of clay and of carrier to be incorporated in the product, the amount of clay which can be dispersed in the selected agglomerating agent while still giving a sprayable dispersion, and the amount of the dispersion which must or can be sprayed on the selected carrier to provide for adhesion of the clay while also forming free-flowing agglomerates.

In compositions prepared by process (b), some or all of the clay for the composition is added in substantially dry, pulverulent form to the crutcher mix, which is thereafter spray-dried to form the spray-dried component of the composition. This spray-dried component of the composition may constitute the whole composition, but more usually built laundry compositions contain components which cannot be subjected to the spray-drying process, and these are dry mixed subsequently with the spray dried granules. Preferably not more than about 15%, more preferably not more than about 10%, of dry clay, should be added to the crutcher mix, by weight of the mix; if more than 15% (or 10%) of clay is desired in the composition, the excess is preferably incorporated by dry mixing or by the process variant (a).

Thus, both process (a) and process (b) may be employed if desired; that is, part of the clay may be incorporated with a carrier by process (a) and part incorporated in the spray-dried component of a product by process (b).

The clay may be mixed with other fine or potentially dusty components of the composition such as enzymes, optical brighteners, whitening or coloring substances, for example titanium dioxide or pigments, when added by either process, subject, of course, to the heat sensitivity of the materials. The agglomerates may be dry mixed with other components, if any, of the final product. Thus depending upon the nature of the carrier these might be spray-dried granules, builders, bleaching agents or other heat sensitive components.

The following Examples illustrate the invention.

EXAMPLE 1

Products were prepared and tested for dustiness and softening effect.

Dust measurements

The dust measurements were carried out by the method and in equipment as described in South African Patent No. 72/3395. 1000 gram samples of each product were poured in the tests.

Softness measurements

Swatches of terry towelling (6 per test) were washed in 0.4% by weight solutions of the test products in a Tergitometer. The solutions were prepared in tap water (172 ppm hardness as $CaCO_3$), and the washing conditions comprised two washes of 2 minutes duration at 50°C, with a cloth to liquor ratio of 1:10, followed by rinsing and drying in still air. The washed and dried swatches were compared by a panel of four judges by a paired comparison technique using a 9 point Scheffe scale. Differences were recorded in panel score units (psu), positive being preferred, and the least significant difference (LSD) at 95% confidence was also calculated and recorded.

Product 1

A spray dried detergent composition of formula essentially

| | |
|---|---|
| Sodium linear dodecylbenzene sulphonate | 28% by weight |
| Sodium tripolyphosphate | 22% |
| Sodium chloride | 6% |
| Sodium sulfate | 38% |
| Carboxymethyl cellulose | 0.5% |
| Moisture | 4% |
| Miscellaneous | 1.5% |

Product 2

Five parts by weight of "Soft Clark" clay were dry mixed with 100 parts of Product 1.

Product 3

As product 2, except that "Thixogel" was employed in place of "Soft Clark". ("Soft Clark" and "Thixogel" are trade names of smectite-type clay marketed by Georgia Kaolin, Elizabeth, New Jersey, U.S.A. "Thixogel" is a predominantly sodium-based clay which swells strongly in water; "Soft Clark" is a predominantly calcium-based clay which swells moderately in water.)

Product 4

310 g Gran M STPP (sodium tripolyphosphate) were dry mixed with 640 g of Product 1. ("Gran M" STPP [trade name] is a granular form of sodium tripolyphosphate having particulate size such that at least about 80% is retained on a 100 mesh BSS Test Sieve.)

Product 5

Five parts by weight of "Soft Clark" clay were dry mixed with 100 parts of Product 4.

Product 6

A dispersion was prepared containing 75 g of "Soft Clark" clay dispersed in 161 g of a solution containing 5% by weight of disodium pyrophosphate, and 2½% by weight of sodium chloride. The dispersion was sprayed on to 484 g of Gran M STPP in a pan granulator. The granular mixture so formed was dry mixed with 855 g of Product 1.

Product 7

161 g of the clay dispersion employed for making Product 6 were sprayed on to 855 g of Product 1 in a pan granulator and the granular mixture so formed was dry mixed with 484 g of Gran M STPP.

Product 8

75 g of Thixogel clay were dry mixed with 484 g of Gran M STPP and sprayed in a pan granulator with 161 g of the electrolyte solution employed in making the clay dispersion for Product 6. The granular mixture so formed was dry mixed with 855 g of Product 1.

Product 9

75 g of "Thixogel" clay were dry mixed with 855 g of Product 1 and sprayed in a pan granulator with 161 g of the electrolyte solution employed in making Product 8. The granular mixture so formed was dry mixed with 484 g of Gran M STPP.

Product 10

This was made in the same manner as Product 8, except that the clay was omitted.

Product 11

855 g of Product 1 and 484 g of Gran M STPP were dry mixed and sprayed in a pan granulator with 161 g of the electrolyte solution employed in making Product 8. 75 g of "Soft Clark" clay were dry mixed with the mixture so formed.

Product 12

This was prepared in the same manner as Product 11, except that the clay was omitted.

Table 1

| Product | 1 | 2 | 3 | 4 | 5 | 6 | 7 | 8 | 9 | 10 | 11 | 12 | LSD |
|---|---|---|---|---|---|---|---|---|---|---|---|---|---|
| Test | Dust ratings (Micrograms per 100 grams of product) | | | | | | | | | | | | |
| a | 3870 | 11900 | | | | | | | | | | | |
| b | | | | 3440 | 9270 | | | | | | | | |
| c | | | | | | 1006 | 257 | 1290 | 247 | | 2314 | | |
| | Softness ratings (psu) | | | | | | | | | | | | |
| d | | | | | +0.7 | | | | | −0.7 | | | 0.3 |
| e | | | | | | | +1.1 | | | −1.1 | | | 0.3 |
| f | | | | | | | | | +1.0 | | | −1.0 | 0.2 |
| g | | | | | | | | +0.8 | | | | −0.8 | 0.2 |
| h | −0.9 | | +0.9 | | | | | | | | | | 0.3 |
| j | −1.1 | +1.1 | | | | | | | | | | | 0.4 |

Products 6 to 9 are according to the invention, and the others are included for comparison.

Tests *a* and *b* demonstrate increase in dustiness caused by simply dry mixing clay with compositions corresponding to those used in preparing the compositions according to the invention.

Test *c* demonstrates very low dust readings for compositions according to the invention, and shows that they are lower than the reading for the same base sprayed with electrolyte solution but with clay dry mixed.

Tests *d*, *e*, *f*, and *g* compared with tests *h* and *j* demonstrate that the processes of the invention do not significantly impair the softening effect of the addition of clay.

EXAMPLE 2

Swatches of Terry towelling (9 per test), together with further towelling to make up a 4 lb. load, were washed with the test detergent compositions in a domestic washing machine (Hotpoint Supermatic). The load was given a 6 minute wash in 8 gallons of wash liquor at 130°F, and then the test pieces were rinsed twice by hand. After air drying, they were evaluated for softness by a team of four judges, using a paired comparison technique and a 9 point Scheffe scale. Softness values were recorded in panel score units (p.s.u.) and the least significant difference (LSD) at 95% confidence relative to the error of the test was calculated.

The test fabrics were then washed and rinsed four times more (five washes in all) in the same way and evaluated again for softness.

Products tested were:

A. Built detergent composition containing:
5.4% sodium dodecyl benzene sulfonate
3.6 sodium tallow alcohol sulfate
1.2 ethanol coconut fatty acid amide
2.4 soap
35. sodium tripolyphosphate
26. sodium perborate tetrahydrate
7 sodium silicate
8 sodium sulfate
11.4 water and minor components B. The same with 5% Thixogel added by weight of detergent composition, dry mixed.

C. The same with 5% Thixogel clay on the same basis added to the crutcher mix.

D. The same with 5% Soft Clark clay on the same basis added to the crutcher mix.

| | Test Conditions and Results (p.s.u. -more positive values = softer) | | | |
|---|---|---|---|---|
| Number of washes | 1 | 5 | 1 | 5 |
| Water Hardness | 18° | 18° | 12° | 12° |
| Detergent concentration | 0.53% | 0.53% | 0.46% | 0.46% |
| Product A | −1.3 | −1.6 | −1.0 | −1.1 |
| Product B | +1.3 | +1.6 | — | — |
| Product C | — | — | +0.2 | +0.5 |
| Product D | — | — | +0.8 | +0.5 |
| LSD | 0.4 | 1.0 | 0.8 | 0.6 |

EXAMPLE 3

Detergent compositions were prepared in full-scale commercial spray-drying plant and had the following essential formulas:

| Composition | A | B |
|---|---|---|
| Sodium dodecyl benzene sulfonate | 28 (wt.%) | 28 (wt.%) |
| Sodium toluene sulfonate | 1 | 1 |
| Sodium tripolyphosphate | 20 | 20 |
| Sodium chloride | 6 | 6 |
| Sodium sulfate | 32 | 37 |
| Clay ("Soft Clark") | 5 | — |
| Moisture | 5 | 5 |
| Minor components, impurities etc. | 3 | 3 |

The clay was added to the crutcher mix before spray drying.

Terry-towelling test pieces were washed as in Example 1 in these compositions, but using 10° hard water and a product concentration of 0.5% by weight. Their softness was compared, using a paired comparison technique, by a panel of judges. The results, in panel score units (more positive meaning softer), were:

Composition A +1.0

Composition B −1.0

Least significant difference (95% confidence) 0.2

The dustiness of the products was graded on a 1–10 scale (10 no dust, 7 acceptable, 1 very dusty) and the results were:

Composition A 7.8 (mean of 5 readings ranging from 8.9 to 5.7)

Composition B 7.6 (mean of 3 readings ranging from 8.2 to 7.3)

A sample of Composition B into which 5% of the clay had been dry mixed gave a rating of 4.4.

What is claimed is:

1. Process for preparing a built laundry detergent composition comprising the step of spraying a moving bed of a particulate carrier selected from the group consisting of sodium and potassium tripolyphosphate, pyrophosphates, acid pyrophosphates, carbonates, sulfates, borates, and silicates and spray dried built synthetic detergent granules containing a hydratable, inorganic salt dried to such an extent that the salt is incompletely hydrated, said moving bed containing up to 50% by weight of a smectite-type clay softening agent having an ion exchange capacity of at least 50 meq/100 g, with a liquid agglomerating agent selected from the group consisting of aqueous solutions of electrolytes containing no more than 75% of saturation of said electrolytes and said electrolytes being selected from the group consisting of water soluble phosphates, tripolyphosphates, acid pyrophosphates, neutral pyrophosphates, carbonates, sulfates, chlorides, borates, silicates and mixtures thereof; water; and solutions of organic adhesives, said liquid agglomerating agent containing up to 60% by weight of said clay, the weight ratio of said agglomerating agent to the combined weight of said clay and said carrier being from 1% to 40%, to form free-flowing agglomerates.

2. The process of claim 1 wherein the carrier is selected from a group consisting of incompletely hydrated sodium tripolyphosphate and tetrasodium, and disodium pyrophosphates.

3. The process of claim 1 wherein the liquid agglomerating agent is selected from the group consisting of said aqueous solutions of electrolytes and water.

4. The process of claim 1, wherein the carrier is selected from the group consisting of incompletely hydrated sodium tripolyphosphate, tetrasodium and disodium pyrophosphates, and spray-dried built synthetic detergent granules.

5. The process of claim 2 wherein the liquid agglomerating agent is selected from the group consisting of said aqueous solutions of electrolytes and water.

6. The process of claim 4 wherein all the clay is dispersed in the agglomerating agent so as to provide a sprayable dispersion and the dispersion is sprayed onto a moving bed of the carrier to form free-flowing agglomerates.

7. The process of claim 4 wherein the clay and the carrier are dry mixed and a moving bed of the mixture is sprayed with an agglomerating agent to form free-flowing agglomerates.

8. The process of claim 6 wherein the dispersion of clay in the agglomerating agent contains from 20 to 50% of clay by weight of the dispersion.

9. The process of claim 8 wherein the agglomerating agent is selected from the group consisting of aqueous electrolyte solutions that are less than 75% saturated and fatty acids having 10–24 carbon atoms.

10. The process of claim 9 wherein the agglomerating agent is an aqueous solution containing from 3 to 10% by weight of an electrolyte selected from the group consisting of disodium pyrophosphate and a 2:1 by weight mixture of disodium pyrophosphate and sodium chloride.

11. The process of claim 10 wherein the carrier is sodium tripolyphosphate and it is sprayed with about 50% by weight of a dispersion containing 33% by weight of clay in an aqueous solution containing 5% disodium pyrophosphate and 2½% sodium chloride.

* * * * *